United States Patent [19]

Kroffke

[11] 3,938,425

[45] Feb. 17, 1976

[54] PUMP STROKE ADJUSTMENT DEVICE

[75] Inventor: Kenneth K. Kroffke, Cleveland, Ohio

[73] Assignee: Houdaille Industries, Inc., Buffalo, N.Y.

[22] Filed: Apr. 15, 1974

[21] Appl. No.: 460,907

[52] U.S. Cl. ..... 92/60.5; 417/274; 417/498

[51] Int. Cl.[2] ..... F01B 31/14

[58] Field of Search ..... 417/274, 498, 437; 92/60, 92/60.5, 13.8

[56] References Cited

UNITED STATES PATENTS

| | | | |
|---|---|---|---|
| 1,932,921 | 10/1933 | Bizzarri | 92/60 |
| 2,383,324 | 8/1945 | Le Clair | 92/60 |
| 2,619,907 | 12/1952 | Paterson | 92/60 |
| 2,739,643 | 3/1956 | Voit et al. | 417/274 |

FOREIGN PATENTS OR APPLICATIONS

| | | | |
|---|---|---|---|
| 385,887 | 1/1933 | United Kingdom | 92/60 |
| 501,780 | 7/1930 | Germany | 92/60 |

*Primary Examiner*—Carlton R. Croyle
*Assistant Examiner*—O. T. Session
*Attorney, Agent, or Firm*—Hill, Gross, Simpson, Van Santen, Steadman, Chiara & Simpson

[57] ABSTRACT

A piston type fluid pump structure providing a selective variable operating fluid displacement, and including a piston having an operable travel, within a cooperable cylinder bore, through a pump stroke which may be of fixed length, a fluid supply port being provided which communicates with the interior of the cylinder bore when the piston is in a retracted position and a fluid outlet port communicating with interior of said bore through which fluid therein may be discharged during such pump stroke, an expansion chamber being provided in communication with the cylinder bore adjacent the discharge port therein, the effective volume of the expansion chamber being selectively variable whereby the output displacement of said pump structure may be varied by controlling the volume of said expansion chamber, and therewith the amount of fluid received therein during a pump stroke.

2 Claims, 3 Drawing Figures

PUMP STROKE ADJUSTMENT DEVICE

BACKGROUND OF THE INVENTION

The invention is directed to a structure enabling the rapid and simple adjustment of the operating capacity of a piston-type pump, for example pumps employed in the delivery of lubricant from a supply to a point of usage.

It will be appreciated that in the utilization of a piston-type pump as a lubrication delivery mechanism, it often becomes desirable to effect an adjustment of the amount of fluid discharged by the pump at each piston stroke, both for effecting changes in the volume of lubricant delivered to a specific mechanism as well as to enable adjustment of the pump for different types of mechanisms, thereby rendering the pump substantially universal in application.

Provisions have been made in prior pumps of this general type to achieve at least some degree of variation in the pump output.

Where the displacement piston of such a pump is actuated by hydraulic or pneumatic means, i.e. a pneumatic or hydraulic piston operatively connected to the displacement piston, the stroke adjustment may be achieved by the utilization of an adjustable stop which will physically limit the travel of the displacement piston during its pump stroke. The adjustable stop may, for example, be merely a simple threaded screw disposed in the path of the piston with the position of the free internal end of the adjustment screw thus determining the end of the piston travel. While this may be acceptable for a pneumatic or hydraulic structure, wherein the piston can be stopped at an intermediate point of its maximum stroke, where a mechanical drive is employed such as a "swash plate", or other mechanical linkage, the piston movement cannot conveniently be stopped at an intermediate point, and a more elaborate arrangement must be employed to adjust the volume to be delivered. In such case, adjustment can be effected by substitution of one swash plate for another but this change involves at least a partial dismantling of the pump structure. Another solution has involved the adjustment of the position of the cylinder, in which the displacement piston of the pump is reciprocable, so that the amount of operative travel of the piston in the cylinder can be varied thus adjusting the effective pump stroke.

BRIEF SUMMARY OF THE INVENTION

The present invention is directed to the elimination of the disadvantages of the previous structures and to provide a simple adjustment which eliminates the wear experienced with a positive screw stop which is struck by the piston, and which does not involve the adjustment of the cylinder bore in which the displacement piston is reciprocable.

The invention is directed to a pump structure in which the travel of the displacement piston may be fixed, whereby any suitable means may be employed to reciprocate the piston, with the displacement volume being adjustable from zero to maximum volume, without adjustment or change in the stroke of the displacement piston, and with the volume being readily adjustable exteriorly of the pump structure by means of a simple adjusting member.

The desired results are achieved by the employment of an expansion chamber in communication with the interior of the cylinder bore carrying the displacement piston, into which expansion chamber a selectible portion of the displacement volume of the pump stroke may be received, with the remainder of the displacement volume being discharged through the outlet port of the pump structure. Thus by suitable adjustment of the effective volume of the expansion chamber, the volume discharged through the outlet port may be readily and accurately adjusted from zero to the full displacement volume of the displacement piston.

Adjustment in the effective volume in the expansion chamber may be achieved by providing a movable member which may, for example, form a wall of the expansion chamber and thus by its adjustment vary the effective volume thereof. In the preferred embodiments of the invention illustrated, such movable member comprises an adjustment piston which is movable in the expansion chamber, for example, being spring biased in minimum-volume position and adapted to be moved, in volume-increasing direction, under the action of fluid in response to movement of the displacement piston. Expediently, the control piston may have a maximum movement from a minimum volume position in which all fluid displaced by the displacement piston is discharged through the pump outlet port, to a maximum volume position in which all of the displaced fluid is accommodated in the expansion chamber and thus zero discharge flow. Adjustment of the pump output may be readily effected by a suitable stop member, for example, a threaded stop member, which determines the end of the volume-increasing movement of the control piston and thus the amount of fluid to be received in the expansion chamber. Preferably, the pump output is supplied at a predetermined pressure, for example, as determined by a suitable biased check valve, with the pressure required to discharge through the check valve being greater than the biasing force on the control piston whereby upon actuation of the displacement piston, the control piston will move in volume-increasing direction until it reaches the end of its adjusted travel, following which further movement of the displacement piston will result in discharge of fluid through the pump outlet port. The amount of fluid so discharged thus is the difference between the volume displaced by the displacement piston and the volume received in the expansion chamber. By rendering the control piston immovable at its minimum-volume position, the full volume displaced by the displacement piston will be discharged from the pump whereas, in the event the control piston is adjusted to permit movement thereof sufficient to enable reception in the expansion chamber of the total amount of displacement of the displacement piston, zero fluid flow will take place through the outlet port. Thus, by suitable adjustment of the control piston, the output of the pump may be continuously varied from zero to full output.

BRIEF DESCRIPTION OF THE DRAWINGS

In the drawings wherein like reference characters indicate like or corresponding parts.

DETAILED DESCRIPTION OF THE INVENTION

Figure 1:
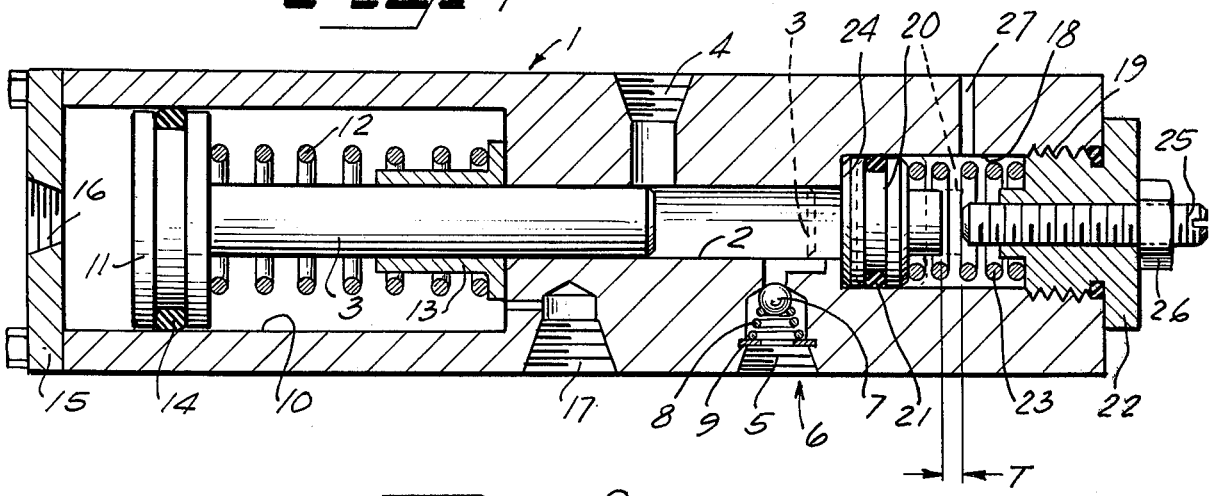
FIG. 1 is a longitudinal sectional view through a pump structure embodying the present invention.

Referring to the drawings and more particularly to FIG. 1, the reference numeral 1 indicates generally a pump body having a cylinder bore 2 therein in which is reciprocally carried a displacement piston 3, fluid being supplied to the bore 2 through a fluid inlet, indicated generally by the numeral 4, communicating with the bore 2 when the piston 3 is in a retracted position such as illustrated in FIG. 1. Fluid may be discharged from the bore 2 through a fluid outlet port 5, which in the embodiment illustrated is provided with a ball check valve, indicated generally by the numeral 6, and comprising a spherical valve member 7 biased in a closed position by a spring 8, the lower end of which, as illustrated in FIG. 1, is retained in operative position by a suitable expansion-type lock ring 9. Thus fluid will be discharged through the outlet port 5 when the fluid pressure in the cylinder bore 2 exceeds a predetermined minimum as determined by the spring 8.

For illustrative purposes the piston 3 is illustrated as being adapted to be actuated pneumatically or hydraulically by means of an associated cylinder 10 in which is reciprocally carried an actuating piston 11 illustrated as being rigidly secured to the adjacent end of the displacement piston 3 with the latter being urged in retracted position, i.e. toward the left as viewed in FIG. 1, by a compression spring 12 disposed in the cylinder 10 and bearing at one end on a suitable seal member 13, and at the opposite end on the piston 11. The latter may be provided with a sealing O-ring 14 or equivalent for preventing fluid flow between the cylinder wall and the adjacent circumferential face of the piston 11. The end of the cylinder bore 10 is adapted to be closed by a suitable cover plate 15 or the like, illustrated as having a fluid inlet port 16 by means of which air or liquid may enter the cylinder to actuate the piston 11 and thus advance the displacement piston 3 through a pump stroke, pressure being relieved behind the piston 11 through a suitable port 17 which in such case would be vented to atmosphere.

As illustrated, the body 1 is provided with a counterbore 18 which communicates with the adjacent end of the cylinder bore 2, with such counterbore opening on the righthand end of the body 1 as viewed in FIG. 1, the outer portion of such counterbore being provided with internal threads 19. Disposed in the counterbore 18, and reciprocable therein is a control piston 20, the latter in the embodiment illustrated being provided with a suitable O-ring 21 or other sealing means preventing liquid flow between the side walls of the counterbore and the adjacent circumferential face of the control piston. The outer end of the counterbore is closed by a plug member 22, provided with external threads mating with the threads 19, which is thereby firmly screwed to the body 1. The piston 20 in the embodiment illustrated, is urged toward the bore 2 by a compression spring 23, having one end seated on the plug 22 and the opposite end seated on the adjacent face of the piston 20, with such movement of the piston being limited by the bottom face 24 of the counterbore.

Movement of the piston in the opposite direction toward the plug 22 is adjustably limited by an adjusting screw 25, threaded into the plug 22, with the free inner end of such screw adapted to form a stop for limiting movement of the piston 20. The adjusting screw 25 may be locked in any position of adjustment by means of a suitable lock nut 26 threaded thereon. The portion of the counterbore extending between the piston 20 and the plug 22 is adapted to be vented by a suitable vent port 27.

It will be appreciated that the left-hand end of the counterbore 18 adjacent the bore 2 and the piston 20 are cooperable to define an expansion chamber, the size of which is dependent on the amount of travel permitted of the piston 20, as determined by adjustment of the screw 25. Thus, assuming that the piston 20 is not locked in the position illustrated in FIG. 1 by the screw 25, but is thus permitted a predetermined amount of travel, as determined by the spacing between the inner end of the screw 25 and the adjacent end face of the piston 20, such travel being identified by the letter T in the drawing, operation of the embodiment illustrated in FIG. 1 is as follows:

With an adjustment of the control piston 20 as illustrated in FIG. 1, the displacement piston 3 will be at a predetermined point of retraction, for example that illustrated in FIG. 1, in which the inlet port 4 is at least partially exposed and thus communicates with the interior of the bore 2 whereby the fluid to be pumped, for example a lubricant, may enter and fill the bore 2. At the same time the piston 20, in response to the action of the spring 23 will be at the extreme end of its travel toward the bore 2. As the piston 3 begins its pump stroke it will initially cover the adjacent end of the fluid supply inlet 4, at which time the piston will begin its effective displacement stroke and thereupon exert pressure upon the fluid within the bore 2, which pressure will be opposed by the piston 20 and spring 23 as well as the ball 7 and spring 8 of the check valve 6. The spring 23 is so calibrated that it will exert less operative force on the piston 20 than the spring 8 exerts on the check valve ball 7, so that initial displacement of fluid in the bore 2 will result in a corresponding displacement of the piston 20, moving the same to the right as viewed in FIG. 1 against opposition of the spring 23, and displaced fluid will thus be received in the expansion chamber formed by the counterbore 18 and the piston 20. Fluid will continue to be displaced into the expansion chamber until the piston 20 hits the adjacent end of the screw 25, thereby preventing further movement of the piston. As the displacement piston 3 continues its pump stroke the pressure in the bore 2 will exceed the action of the spring 8 whereby fluid will be discharged through the outlet 5, with the amount of fluid so discharged being the amount of displacement of the piston 3 after the piston 20 has seated on the screw 25.

The amount of fluid pumped through the outlet 5 thus is the difference between the total displacement of the piston 3, following closure of the inlet 44 to the end of the pump stroke thereof, and the volume of the fluid received into the expansion chamber during the travel of the piston 20. As the screw 25 is turned into the plug 22, reducing the travel of the piston 20, a corresponding greater amount of fluid will be discharged through the port 5, and if the screw 25 is so adjusted that the piston 20 is retained in its extreme end position illustrated in FIG. 1, the fluid discharged through the outlet 5 will correspond to the effective displacement volume of the piston 3. Likewise, the size of the counterbore 18 and the maximum design travel of the piston 20 preferably will be such that the volume resulting from the maximum travel of the piston 20 toward the screw 25 will substantially equal the displacement volume of the piston 3, whereby all of the displaced fluid in the bore 2 would be received into the expansion chamber, in which adjustment the output would be zero. The pump thus would be continuously adjustable from zero flow to maximum merely by suitable adjustment of the screw 25.

It will be appreciated that while I have illustrated the association of a check valve or its equivalent with the outlet port 5, which check valve could be incorporated as an integral part of the pump structure or disposed at any suitable point in the outlet supply line, in some cases the internal resistance in the line or at the point of use of the fluid may be sufficiently great to exceed the force exerted by the spring 23, in which case the check valve structure could be omitted.

It will also be appreciated that while I have illustrated a pneumatic or hydraulic actuation of the drive piston, any suitable means may be employed therefor, for example mechanical, electrical, etc. and that regardless of the means of actuating the piston 3, the piston may be driven through a full stroke without any adjustment whatsoever in the length thereof. This is of course particularly true where mechanical means, such as a swash plate, or other means is employed which impart a stroke of fixed length to the piston.

Figure 2:
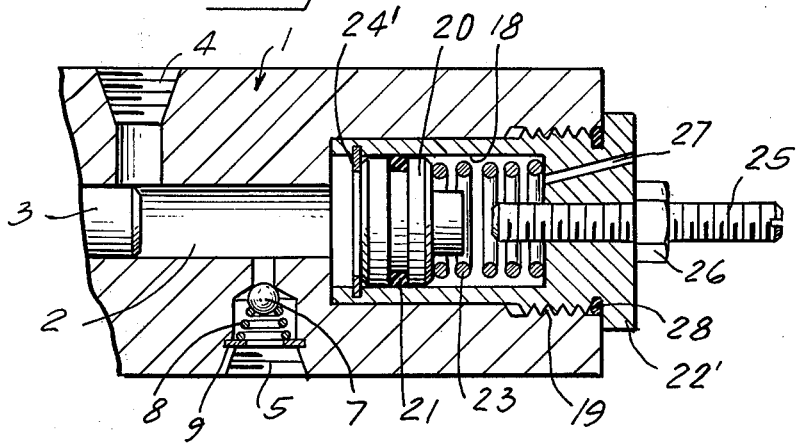
FIG. 2 is a similar sectional view of a modification of the adjusting structure illustrated in FIG. 1.

FIG. 2 illustrates a modification of the construction illustrated in FIG. 1, in which the plug 22' is in a form as a sleeve member having a bore 23 therein, in which is carried the piston 20, movement of the piston toward the bore 2 being limited by a suitable internal lock ring 24'. The remaining components correspond to those of FIG. 1 and are likewise referenced. In this construction however, the junction between the plug 22 and the body 1 is sealed by suitable means such as an O-ring 28 or the like.

Operation of the construction of FIG. 2 is basically identical to that described for FIG. 1. The construction of FIG. 2 is advantageous in that the adjusting structure comprising the plug 22', piston 20, spring 23, adjusting screw 25, etc. can be fabricated and assembled as a sub-assembly and merely inserted into the body 1.

Figure 3:
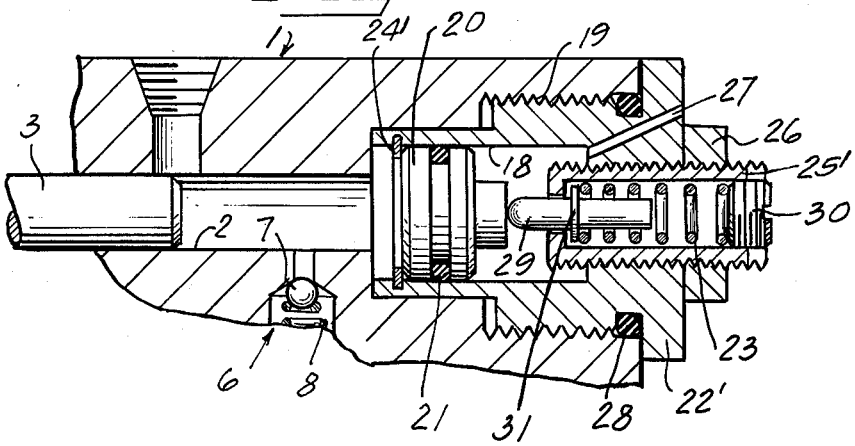
FIG. 3 is a sectional view similar to FIG. 2 of a further embodiment.

FIG. 3 illustrates a further modification of the construction illustrated in FIG. 2, also utilizing a sleeve member 22' having the bore 18 therein in which the piston 21 is reciprocably carried. In this construction the screw 25 is replaced by a tubular housing member 25' which carries a plunger 29 adapted to bear on the adjacent face of the piston 20. The plunger 29 is urged in a direction toward the piston 20 by a compression spring 23, one end of which bears upon a plug 30, closing the outer end of the member 25', and at its inner end bears on a lock ring 31 disposed in an annular slot in the plunger 29, whereby the plunger 29 is urged in a direction toward the piston 20 and the latter in turn is urged to its fully extended position as illustrated in FIG. 3. In other respects the construction is similar to that illustrated in FIG. 2. It will be noted that the travel of the piston 20 in this case is determined by the spacing between the inner end of the housing 25' and the adjacent face of the piston 20 with the adjustment being determined by the amount the housing 25' threaded into the sleeve member 22'. As previously described with respect to the construction illustrated in FIG. 1, and which is also applicable to FIG. 2, the spring 23 is so calibrated that the piston 20 will move in chamber-increasing direction, and fluid will not be discharged through the outlet port 5 until the piston 20 has reached the end of its adjusted travel, i.e. engaged the adjacent end of the housing 25'.

It will be appreciated that in all of the constructions illustrated the amount of fluid discharged from the pump structure is totally independent of the total travel, which may be of a fixed length, of the displacement piston 3 and is thus dependent entirely upon the adjustment of the control piston 20 and the distance which it may travel before fluid is discharged from the pump.

It will also be noted that the adjustment may be varied from substantially zero output to full output merely by the simple adjustment of the screw 25 or housing 25', which may be readily accomplished without disassembly of the pump structure and which maybe accomplished while the pump is in operation.

Likewise, the structure embodies components which may be quite rugged in construction, and in the event disassembly of the control structure is necessary, for any reason, this may be readily accomplished and replacement made if necessary with an extremely short shut down period. Likewise in the construction of FIGS. 2 and 3, such replacement may be effected merely by substituting a single replacement subassembly, which may be adjusted for a desired output prior to assembly in the pump proper.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In an adjustable positive displacement pump for discharging a selectively variable volume of fluid and having a pump body with a cylindrical wall forming a bore therein, a fluid displacement piston in said bore movable back and forth between a retracted position and an advanced position, a fluid inlet port and a fluid outlet port communicating with said bore, means including a control piston forming a fluid expansion chamber in communication with said bore adjacent said fluid outlet port, said control piston being movable to vary the volume of said fluid expansion chamber, externally adjustable abutment means engageable with said control piston for selectively limiting the movement thereof in a volume-increasing direction, means biasing said control piston in a volume-decreasing direction, check valve means in communication with said fluid outlet port for permitting fluid flow therethrough only when the fluid pressure in said bore exceeds a predetermined minimum outlet pressure, said control piston biasing means being operative to exert a force on said control piston which is less than said predetermined minimum outlet pressure whereby fluid will flow through said outlet port only after said control piston has engaged said abutment means, with the volume of fluid flow through said outlet port being determined by the effective volume of said expansion chamber in dependence upon the adjustment setting of said abutment means, wherein the improvement comprises the relationship between said inlet port and said fluid displacement piston whereby communication between said inlet port and said bore is established by said fluid displacement piston only when the latter is in its retracted position, whereby a vacuum condition is produced in said bore and in said expansion chamber as said displacement piston moves from its advanced to its retracted position to subject the control piston to a vacuum-created bias in a volume-decreasing direction to evacuate said expansion chamber and to draw fluid into said bore after said displacement piston has moved to its retracted position, and communication between said inlet port and said bore is blocked by said fluid displacement piston when the latter moves from its retracted position toward its advanced position.

2. The invention as defined in claim 1 wherein said fluid inlet port is formed in said cylindrical wall.

* * * * *